United States Patent [19]

Lowe

[11] 4,159,068

[45] Jun. 26, 1979

[54] CONTAINER AND DISPENSER FOR DRY PARTICULATED CHEMICALS

[76] Inventor: Henry E. Lowe, North Edward St., Cassopolis, Mich. 49031

[21] Appl. No.: 813,828

[22] Filed: Jul. 8, 1977

[51] Int. Cl.[2] ..... B65B 47/06; B67D 3/00

[52] U.S. Cl. ..... 222/185; 141/352; 141/362; 222/509

[58] Field of Search ..... 222/83.5, 86, 88, 183, 222/185, 325, 506, 509, 545; 141/352, 360, 362

[56] References Cited

U.S. PATENT DOCUMENTS

| | | | |
|---|---|---|---|
| 497,352 | 5/1893 | Ruppel | 141/352 X |
| 2,489,746 | 11/1949 | Buneta | 141/346 X |
| 2,601,941 | 7/1952 | Phillips | 222/545 X |
| 3,089,622 | 5/1963 | Westlake | 222/183 |
| 3,123,107 | 3/1964 | Kappler | 141/352 |
| 3,221,953 | 12/1965 | Shurtleff et al. | 222/545 X |

*Primary Examiner*—Robert J. Spar
*Assistant Examiner*—Francis J. Bartuska
*Attorney, Agent, or Firm*—Marmaduke A. Hobbs

[57] ABSTRACT

A container and dispenser for dry particulated chemicals, such as agricultural pesticides, in which the container has two walls forming a corner at one end of the container, and an opening in the corner for discharging the chemical in the container therefrom. A removable closure seals the opening while the container is being shipped and stored and a retractable closure is disposed within the container for closing the opening when the closure has been removed in preparation for discharging the chemical into the dispensers. The dispenser is so constructed and designed that it holds the container in the position where the opening is at the bottom for discharging the contents from the container, and a projection is provided on the dispenser for retracting the closure disposed in the container when the container is placed in the dispenser. A spring may be provided for urging the closure in the container to its closed position so that the container is automatically closed when it is removed from the dispenser.

11 Claims, 9 Drawing Figures

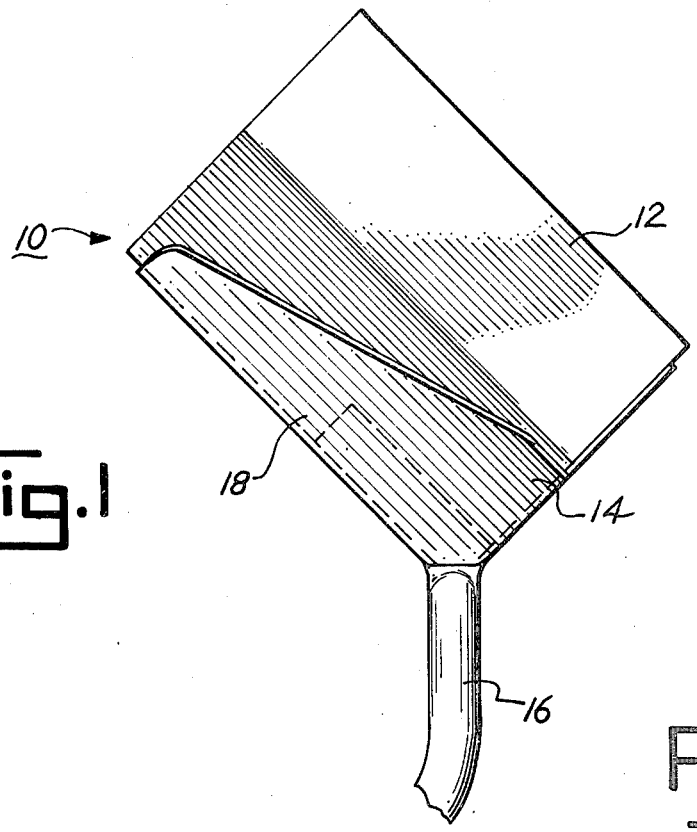
Fig. 1
Fig. 2
Fig. 3
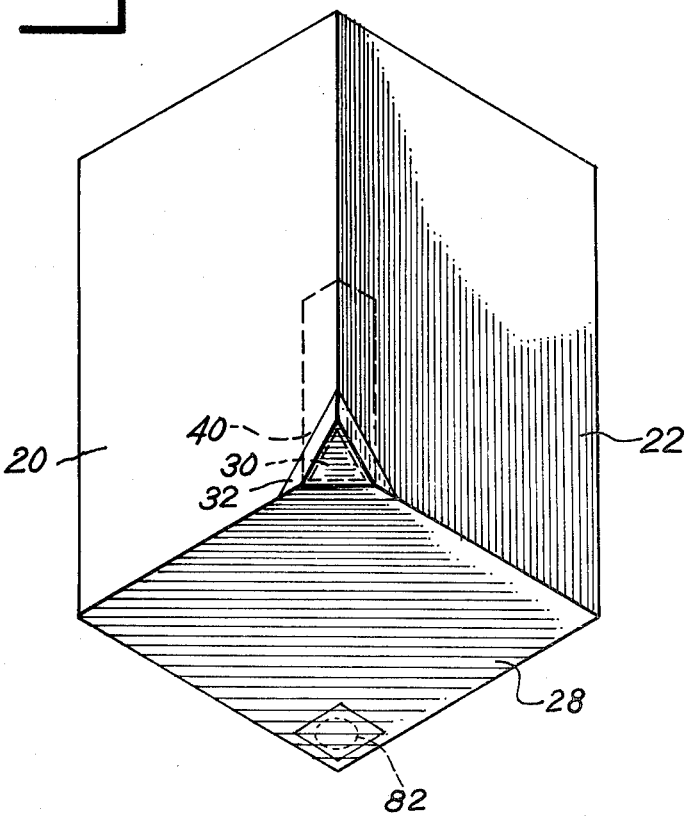
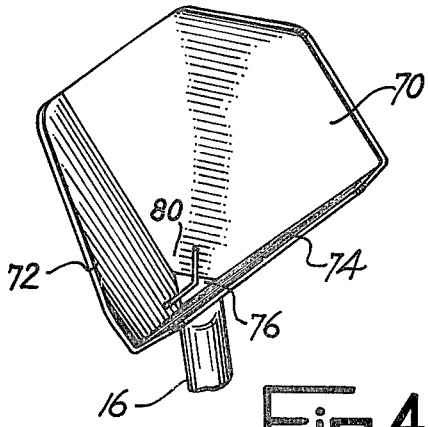
Fig. 4
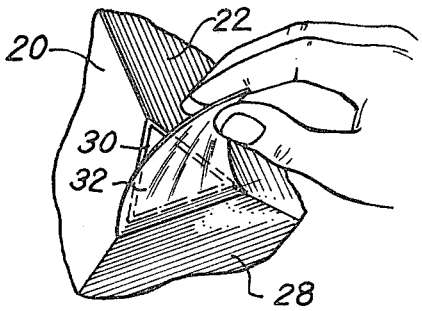

CONTAINER AND DISPENSER FOR DRY PARTICULATED CHEMICALS

Most agriculture equipment used for applying pesticides in the field requires the operator to open the container and pour the pesticide into a receptacle on the equipment from which it is applied on the field. Since many pesticides used in agriculture are of the powdered or dry granular types, dust is discharged into the surrounding air which is often breathed by the operator when the material is poured into the receptacle on the equipment, thereby causing a health hazard to the operator. The same hazard exists in removing any pesticide remaining in the receptacle after the material has been applied to the field. The dry pesticide is usually shipped and stored in bags and boxes which must be opened and lifted to the top of the receptacle on the equipment and the contents then poured in bulk into the receptacle. This places the operator in close proximity to the flying dust and often in direct contact with the pesticide as it is being poured from the bags and boxes. Further, the emptied bags and boxes may still contain a small amount of pesticide which can accidentally be spilled on anyone handling the emptied containers while disposing of them. This accidental contamination may also occur to anyone handling, hauling and stacking bags and boxes containing pesticides, and pouring the contents of the bags and boxes into the equipment. It is therefore one of the principal objects of the present invention to provide a container and dispenser combination for pesticides which permits the operator to lift the container into place for use of the contents before the container is effectively opened, and which is so constructed and designed that the container automatically closes itself when the container is removed from the dispenser.

Another object of the invention is to provide a container for pesticides and other hazardous dry particulated chemicals for agricultural use, which can be partially opened with a knife or other cutting tool while the container is in a convenient upright position, and which can be lifted to an inverted position and then fully opened as the container approaches its final emptying position on the equipment, the container thereafter serving as the receptacle for the material while it is being dispensed by the equipment on the field.

Still another object of the invention is to provide a container for pesticides and other dry particulated chemicals, which is simple in construction and can be easily filled and sealed for shipment and storage, and which can be readily opened when the contents are to be used, without subjecting anyone to flying dust or direct contact with the contents.

A further object is to provide a dispenser for holding a container or package for hazardous dry particulated chemicals for agricultural use, which assists in the operation of opening the container and which contains little or no residue after the container has been removed therefrom.

Additional objects and advantages of the present invention will become apparent from the following description and accompanying drawings, wherein:

FIG. 1 is a side elevational view of a container and dispenser for dry particulated chemicals embodying the present invention;

FIG. 2 is a perspective view of the dispenser shown in FIG. 1;

FIG. 3 is a perspective view of the container shown in FIG. 1;

FIG. 4 is an enlarged fragmentary perspective view of the container showing the manner in which the container is sealed and opened;

Figure 5:
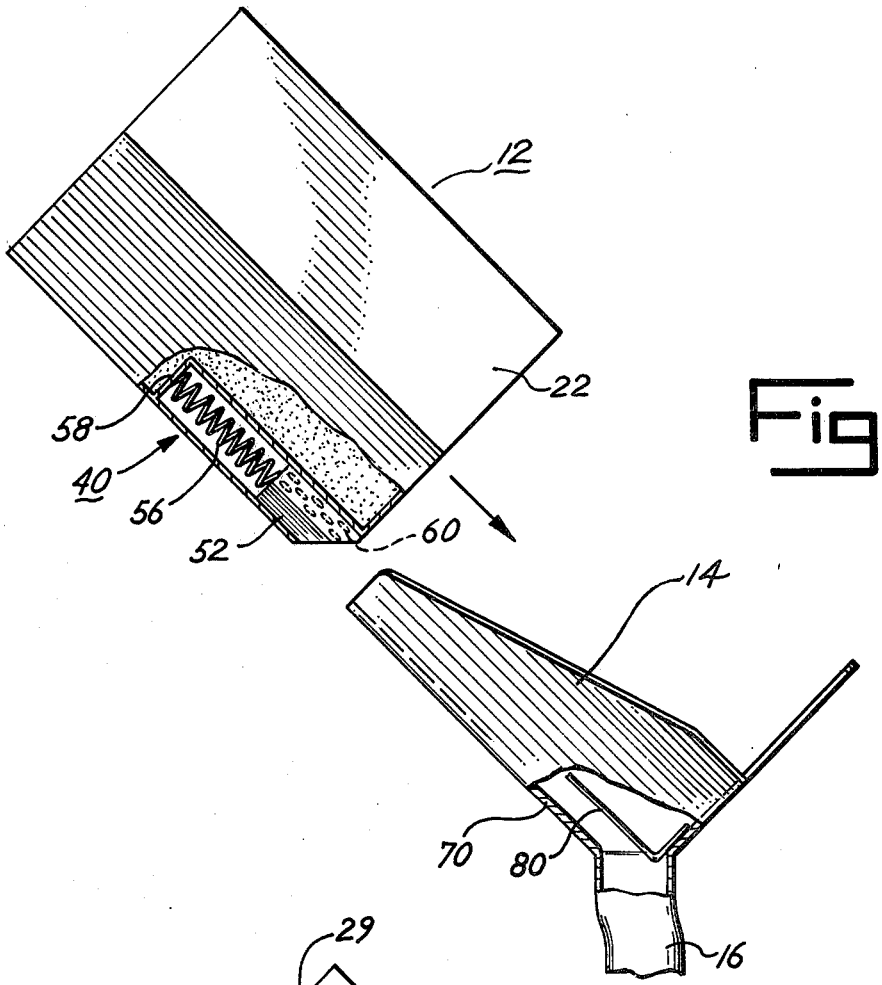
FIG. 5 is a side elevational view of the container and dispenser showing the manner in which the container is mounted in the dispenser for discharging the contents of the container.
Figure 6:
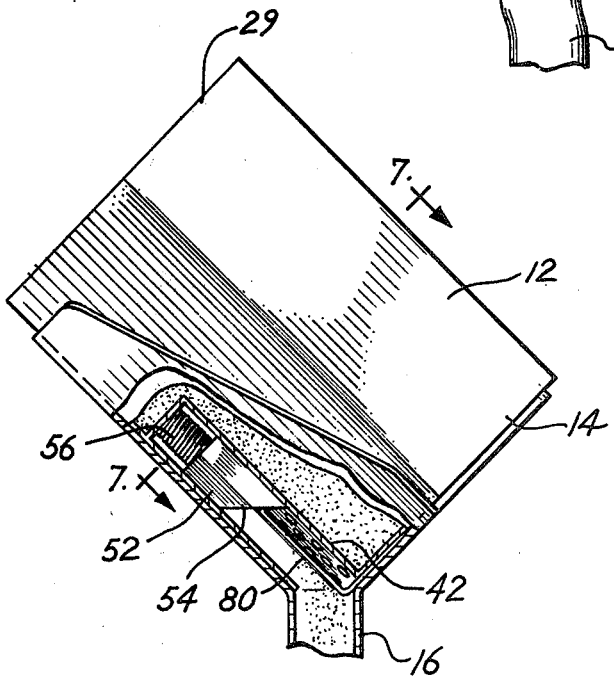
FIG. 6 is a partial cross sectional and side elevational view of the dispenser and container showing the container fully inserted in the dispenser.
Figure 7:
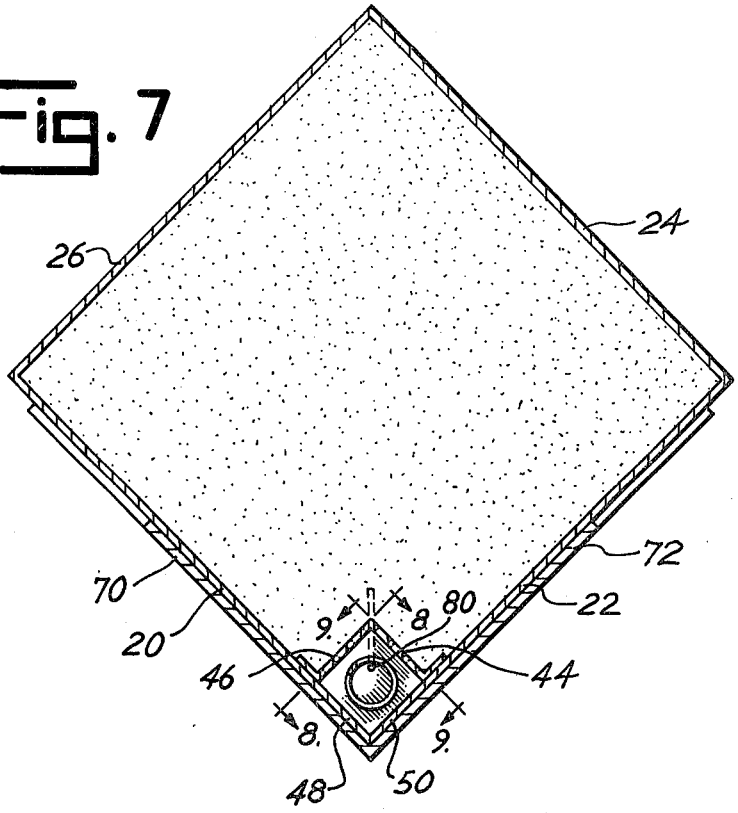
FIG. 7 is a cross sectional view of the container and dispenser, the section being taken on line 7 — 7 of FIG. 6.
Figure 8:
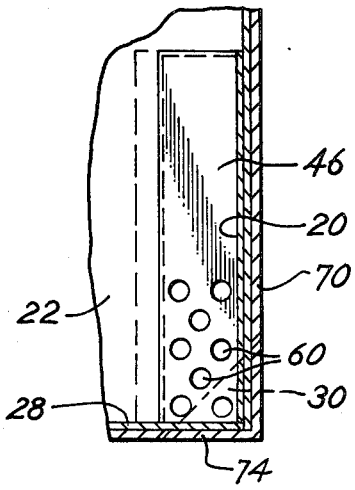
FIG. 8 is an enlarged fragmentary cross sectional view of the container and dispenser, the section being taken on line 8 — 8 of FIG. 7.
Figure 9:
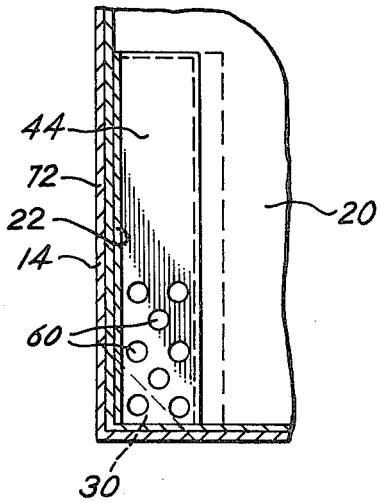
FIG. 9 is an enlarged fragmentary cross sectional view of the container and dispenser, the section being taken on line 9 — 9 of FIG. 7.

Referring more specifically to the drawings, numeral 10 designates generally a container and dispenser combination for dry particulated chemicals showing the container and dispenser assembled in operative position and numerals 12 and 14 indicate the container and dispenser, respectively. The dispenser is normally mounted on agricultural equipment and forms a permanent operating mechanism thereon and is connected to a spreader mechanism on the equipment by a tube 16 which is normally rigidly attached to the bottom of the container holder 18 of the dispenser. The dispenser is preferably constructed of metal or other suitable rigid material which firmly retains the container in its discharging position when the container has been mounted in the dispenser for application of the chemical contents thereof to a field. While the container and/or dispenser may be used primarily for dispensing pesticides, it may be used effectively in dispensing other chemicals, both in the agricultural area and in industrial and home applications. Further, either the container or dispenser is capable of being used without the other, and the container can be used without a dispenser and the dispenser may be used with other types of containers; however, the container and the dispenser are designed to operate most effectively as a unit.

The embodiment of container 12 illustrated in the drawings consists of four cardboard side walls 20, 22, 24, and 26 joined together and joined with cardboard end panels 28 and 29 to form a relatively rigid box-like structure which is of sufficient strength to permit handling, shipping and stacking without being likely to become crushed. The container may be of different sizes; however, it would normally be within the range of 12 to 18 inches in both horizontal and vertical directions, thus permitting easy handling of the filled container. The container may be made of a variety of different materials; however, stiff paper, cardboard and plastic may be used satisfactorily.

One of the principal advantages of the present container and dispenser system is the fact that the container can be opened and placed into the dispenser without creating any appreciable dust in the air surrounding the equipment, thereby avoiding the usual hazard encountered when the agricultural equipment, for example, is supplied with pesticides. A corner opening 30 is sealed by a tab 32 which covers the entire opening and overlaps the margin around the opening and is secured to the container by an adhesive. The tab can be easily removed by lifting and pulling it from one of the three corners of the opening, thereby causing the adhesive to release the tab. However, as an alternative, the tab may be permanently secured to the margin around the hole and the tab, which may be of paper, foil, plastic or fabric, may be torn or cut to expose opening 30.

Merely using a tab to close the hole would not eliminate the possibility of dust in the granular material in the container permeating the air around the container and dispenser when the container is inverted to place it in the dispenser. In order to avoid this hazardous possibility, a second closure 40 is incorporated in the container and forms an inner closure for opening 30, this inner closure remaining closed until it is opened by a second operation after tab 32 has been removed or perforated. The inner closure of the embodiment illustrated in the drawings consists of a rectangular, tubular frame 42 formed by sides 44 and 46 and portions 48 and 50 of side walls 20 and 22, respectively, thus resulting in a square cross sectional structure in the corner immediately inside the container adjacent opening 30. The actual closure consists of a slidable element 52 which preferably has an end 54 corresponding to the angular shape of opening 30. Thus, when element 52 is in its lowermost position as viewed in FIG. 5, for example, the end seats over and closes the opening 30.

The closure element 52 may be releasably held in its closed position by a frangible means, such as a spot of adhesive, so that when the element is opened it remains permanently opened; however, the preferred embodiment, as illustrated in the drawings, includes a coil spring 56 reacting between the inner end of the element and inner end member 58 of the closure structure. The spring thus constantly urges the closure element to its closed position and prevents the contents from pouring from the container while the container is inverted unless the element is positively held in retracted or opened position, as will be more fully explained hereinafter. Side walls 44 and 46 contain a plurality of holes 60 which permit the dry particulated contents of the container to flow readily from the container through opening 30 and hence from the container. When the element 52 is seated in its closed position over opening 30, the side walls of the element close holes 60, thus assuring effective closing of the container by element 52.

The dispenser includes three side walls 70, 72 and 74 adjoined to each other at right angles to form a modified funnel shape structure with an opening 76 in the bottom thereof for receiving the dry chemicals from the container and for permitting the chemical to flow into tube 16. The dispenser is a rigid structure, preferably constructed of metal or plastic material, so that the container is held firmly in the position with opening 30 in its lowermost position when the container is placed in the dispenser. A stem 80 secured to panel 74 and extending upwardly therefrom, projects through opening 30 when container 12 is placed in the dispenser and retracts element 52 to open opening 30 and expose holes 60, thereby permitting the dry particulated chemical contents of the container to flow freely from the container through opening 76 into tube 16. When the container is removed after it has either been fully or partially emptied, spring 56 forces element 52 to its seat at opening 30 as stem 80 is withdrawn from the closure structure 40. Thus element 52 fully closes the container and protects the chemical inside the container as well as preventing the hazardous dust from flying into the air as the container is removed and possibly replaced in the dispenser at a later time.

In the operation and use of the present container and dispenser combination, the container is delivered to the equipment on which the dispenser is mounted, and tab 32 is removed from the container, normally while the container is in the position with the opening at the top of the container. Since element 52 is still closing opening 30 after the tab has been removed, the container can be safely inverted and slid downwardly along walls 70 and 72 in the direction parallel to the upstanding portion of stem 80. When element 52 contacts stem 80, the element is retracted upwardly, i.e. held in a fixed position while the container is moved further downwardly, until the container is fully seated on all three walls of the dispenser. With the element retracted in this manner, both the opening 30 and holes 60 are open, thus permitting the chemical contents of the container to flow freely therefrom through opening 76 into tube 16. When the container is empty, or no further chemicals are required, the container may be removed by merely lifting it upwardly in the direction parallel with wall 70, i.e. parallel to the free end of stem 80, thus permitting element 52 to again seat over the inside of opening 30 and fully close the opening. The spring holds the valve element in closed position regardless of the position of the container, thereby protecting any chemicals of a partially used container and preventing accidental spillage of any residual chemicals in the emptied container while it is being discarded. Further, the container can again be placed in the dispenser by merely inverting it and sliding it along wall 70, in the same manner as when a full container is originally inserted in the dispenser, to use the remaining contents of the container.

It is seen from the foregoing that the container and dispenser combination maintains the container in a sealed condition until it is placed in the dispenser and then automatically closes the container when it is removed from the dispenser, thus providing maximum protection to the one loading the equipment with the pesticide and thereafter the one handling the disposing of the emptied container. The container is normally filled by an opening indicated by numeral 82 in one end, which is permanently sealed after the container has been filled. The container normally is used as a disposable type; however, it could be reused if required, the refilling preferably being accomplished through a second opening such as opening 82.

While only one embodiment of the present container and dispenser for dry particulated chemicals has been described in detail herein, various changes and modifications may be made without departing from the scope of the invention.

I claim:

1. A container and dispenser for dry particulated chemicals, comprising walls forming a substantially rigid container having two adjoining side walls and an end wall at substantially right angles to one another forming a corner at one end of the container and means defining an opening at said corner for discharging the chemical in said container therefrom, a removable closure for said opening, a retractable closure means within said container disposed along said adjoining side walls and having an element moveable in said container in a direction parallel to said side walls toward and away from the corner for also closing said opening, a dispenser means for supporting said container in a position where said corner opening is at the bottom of said container for discharging the contents of said container, and a projection on said dispenser means for retracting said closure means to open said container when said container is placed on said dispenser.

2. A container and dispenser for dry particulated chemicals as defined in claim 1 in which said opening at said corner for discharging the chemical in the container therefrom is in a diagonal position with respect to the two sides and adjoining end.

3. A container and dispenser for dry particulated chemicals as defined in claim 1 in which the element of said retractable closure means has sides corresponding to the shape of the sides of the corner in which it is seated, and a frame retains the element of said closure means in said corner for reciprocating movement to and from said opening.

4. A container and dispenser for dry particulated chemicals as defined in claim 2 in which the element of said retractable closure means has sides corresponding to the shape of the sides of the corner in which it is seated, and a frame retains the element of said closure means in said corner for reciprocating movement to and from said opening.

5. A container and dispenser for dry particulated chemicals as defined in claim 1 in which the element of a resilient means urges said closure means toward closed position.

6. A container and dispenser for dry particulated chemicals as defined in claim 4 in which the element of a resilient means urges said closure means toward closed position.

7. A container for dry particulated chemicals comprising walls forming a substantially rigid receptacle having two adjoining side walls and an end wall at substantially right angles to one another forming a corner at one end of the receptacle, means defining an opening at said corner for dispensing the chemical from the receptacle, a removable closure for said opening in the receptacle, and a closure means in said container disposed along said adjoining side walls and having an element moveable in said container in a direction parallel to said side walls toward and away from the corner also closing said opening and being retractable inwardly to open said opening.

8. A container for dry particulated chemicals as defined in claim 7 in which said opening at said corner for discharging the chemical in the container therefrom is in a diagonal position with respect to the two sides and adjoining end.

9. A container for dry particulated chemicals as defined in claim 8 in which the element of said retractable closure means has sides corresponding to the shape of the sides of the corner in which it is seated, and a frame retains the element of said closure means in said corner for reciprocating movement to and from said opening.

10. A container for dry particulated chemicals as defined in claim 7 in which a resilient means urges the element of said closure means toward closed position.

11. A container and dispenser for dry particulated chemicals as defined in claim 10 in which said resilient means is a coil spring reacting between the inner end of said closure means and said frame.

* * * * *